US007302767B2

(12) United States Patent
McKnight

(10) Patent No.: US 7,302,767 B2
(45) Date of Patent: Dec. 4, 2007

(54) WATER ILLUSION COLUMN

(76) Inventor: David C. McKnight, 4118 Teriwood Ave., Orlando, FL (US) 32812

( * ) Notice: Subject to any disclaimer, the term of this patent is extended or adjusted under 35 U.S.C. 154(b) by 148 days.

(21) Appl. No.: 10/988,196

(22) Filed: Nov. 12, 2004

(65) Prior Publication Data

US 2005/0122592 A1 Jun. 9, 2005

Related U.S. Application Data

(60) Provisional application No. 60/519,716, filed on Nov. 14, 2003.

(51) Int. Cl.
*G09F 19/00* (2006.01)

(52) U.S. Cl. ..... 40/409; 40/454

(58) Field of Classification Search ..... 40/439, 40/407, 410, 441

See application file for complete search history.

(56) References Cited

U.S. PATENT DOCUMENTS 3,711,698 A * 1/1973 Hess ..... 40/407
4,215,500 A * 8/1980 Sharp ..... 40/409
5,200,239 A * 4/1993 Chen ..... 428/13
5,313,727 A * 5/1994 Murray, Jr. ..... 40/410
5,502,908 A * 4/1996 Powell et al. ..... 40/410
6,612,053 B2 * 9/2003 Liao ..... 40/406
2003/0177677 A1 * 9/2003 Acosta, Sr. ..... 40/410

* cited by examiner

*Primary Examiner*—Cassandra Davis
(74) *Attorney, Agent, or Firm*—Beusse Wolter Sanks Mora & Maire, P.A.; James H. Beusse

(57) ABSTRACT

A water flow simulation system for audio and visual illusion has an inner conduit and an outer conduit spaced apart to define a flow channel therebetween. A blower directs a flow of air through the inner conduit from one end to an opposite end where at least some of the air exits and is redirected through the flow channel and back to the blower. The conduits are formed of clear plastic and a light source is positioned to light up a plurality of objects floating in the airflow to produce a visual effect of moving water. A sound source operates concurrently with the blower to produce a sound reminiscent of rippling water. The light source can change colors and strobe to enhance the visible image. A lenticular lens on an inner surface of the outer conduit also enhances the image.

11 Claims, 1 Drawing Sheet

WATER ILLUSION COLUMN

SPECIFIC DATA RELATED TO THE INVENTION

This application claims benefit of the Nov. 14, 2003 filing date of U.S. provisional application No. 60/519,716.

BACKGROUND OF THE INVENTION

The present invention relates to a columnar structure that appears to have water flowing in the structure and, more particularly, to a column that is lighted to simulate water flow in the column using air to move light reflective objects in the column.

DETAILED DESCRIPTION OF THE INVENTION

Figure 1:
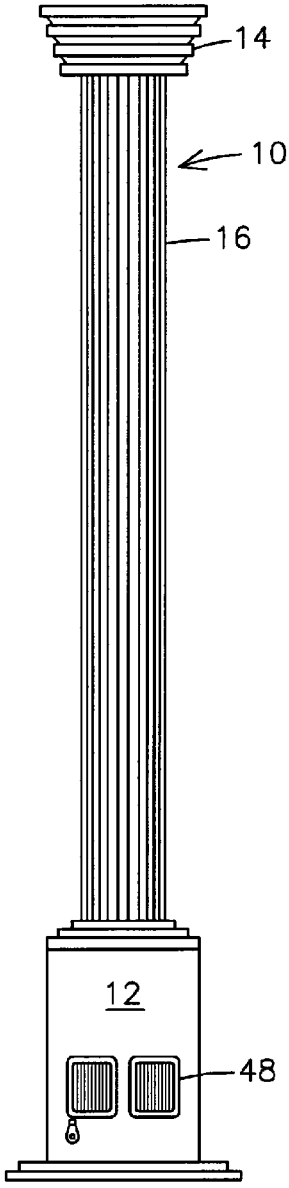
FIG. 1 is an elevation view of one form of the present invention.

FIG. 1 illustrates one embodiment of a simulated water column in accordance with the present invention. The column 10 has three externally visible sections, namely a base unit 12, a top unit 14 and a columnar unit 16. The appearance of each of the units may be varied to represent various styles of classical column structures. Base unit 12 and top unit 14 are typically opaque and may be constructed of various types of materials having sufficient strength to support the columnar unit 16. For example, the units 12 and 14 may be molded from various types of plastic polymers or composites or constructed of wood or metal. The columnar unit 16 is constructed from clear or transparent plastic such as an acrylic.

The column 10 simulates a water column by light reflected from beads of material moving within the columnar unit 16. The beads are moved upwards in the column by airflow generated in base unit 12. Light is directed downward from a source in top unit 14 and reflected from the moving beads. A lenticular lens helps to create the flowing effect. See, for example, U.S. Pat. Nos. 6,635,196 and 6,490,092 for discussions of the use of such lens for optically creating a motion effect. The effect is also enhanced by changing lighting colors, i.e., using red, green, blue or other colors in changing patterns. See, for example, U.S. Pat. Nos. 6,781,329 and 5,528,714 for methods and apparatus for changing light colors in lighting systems.

Figure 2:
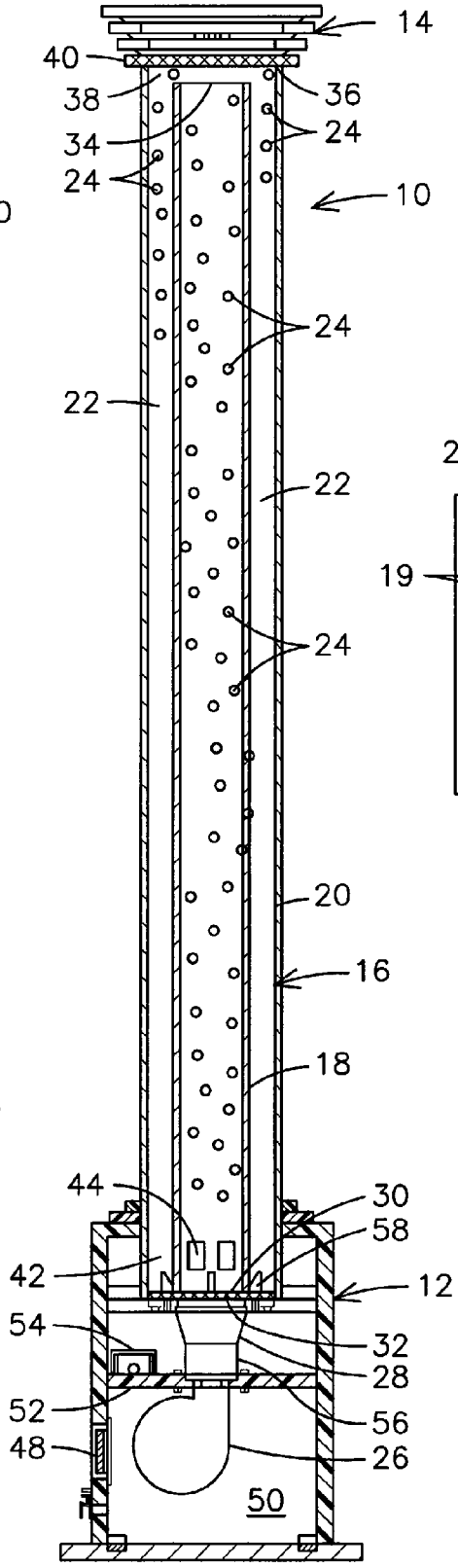
FIG. 2 is a vertical cross-section of FIG. 1.
Figure 3:
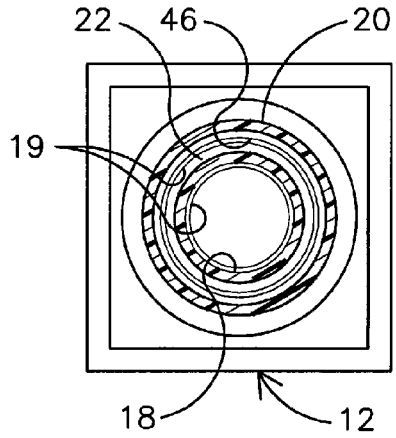
FIG. 3 is a horizontal cross-section of FIG. 1.

Referring to FIGS. 2 and 3, there is shown respectively, a vertical cross-section and a horizontal cross-section of the column 10. In this exemplary embodiment, the columnar unit 16 comprises an inner conduit 18 positioned within an outer circuit 20. The diameters of conduits 18, 20 are selected to provide sufficient space 22 between the conduits to form a return duct (indicated as space 22) for the aforementioned air-movable beads shown at 24. The beads 24 move upward in inner conduit 18 under the impetus of air forced upward in the conduit by air handler 26 located in base unit 12.

Air handler 26 may be any known type of blower such as an electric motor driven squirrel cage blower of the type used in conventional household air conditioning or furnace systems. The air handler 26 could also be a compressed air source or a common propeller blade fan. Air from the air handler 26 is directed through appropriate in-line filters, not shown, but of a type well known in the art, and via ductwork 28 to a first or lower end 30 of conduit 18. A mesh screen 32 is preferably positioned at outlet end of ductwork 28 to prevent beads 24 from falling into the ductwork 28 when the system is not operating. While Applicant prefers use of a blower in base unit 12, it will be recognized that the structure could be inverted and have the blower in the top unit.

The beads 24 are blown upward through conduit 18 and exit at second or upper end 34. The conduit 18 is shorter than conduit 30 so end 34 is below an upper end 36 of conduit 20. The top unit 14 is seated on and attached to conduit 20 so as to form an upper air space at 38 for the beads 24 to transition into the return duct source 22. A panel 40 that may comprise a screen or a clear acrylic or other plastic sheet prevents the beads from being blown into the top unit 14. The beads 24 fall and are blown downward through return duct 22 and accumulate in the space 42 near the lower end 30 of conduit 18. A plurality of openings 44 in conduit 18 allow the upward moving air to pull the beads 24 back into conduit 18 using the Venturi effect so that the beads are continually circulated. Alternately, the beads 24 may be simply allowed to return to conduit 18 via a space formed between the lower end 30 and bottom end of conduit 20, i.e., an arrangement similar to the upper end of the conduits. In this form, however, positioning of the duct 28 is critical to prevent air from being directed upward into space 22.

The beads 24 are a lightweight product and may be made from expanded polystyrene (EPS) or other similar lightweight material. EPS is somewhat heavier than styrofoam and has a firmer outer layer that reduces "sticking". Applicant has found that Styrofoam beads are too lightweight to work effectively. The air handler 26 preferably uses a variable speed blower that is electrically controlled to enable varying the airflow rate. It is also possible to use mechanical means such as air bypasses or vents to vary airflow. By varying airflow, the system can create not only the illusion of flowing water but, with higher airflow rates, also the illusion of an electrical plasma flow including pulsating particle flow. The pulsating effect at lower flow rates enhances the "ripple" effect characteristic of some water flows. Further, varying airflow causes a swirl and swoop effect in the visual display. Devices for speed control of air handlers and such controllable air handlers are well known in the art and commercially available from numerous sources. The beads 24 may be spheroids or irregular in shape. The light source located in top unit 14 and indicated at 46 may be an LED array or colored halogen lighting. It is also possible to use a white light source with colored filter such as the type available from Super Vision International, Inc. of Orlando, Fla. In such systems, the light may be brought to unit 14 via optical fiber in the manner as disclosed in U.S. Pat. No. 5,528,714. Either LED or optical fiber lighting could be used to illuminate the display from other directions such as by incorporating lighting axially along the structure or by lighting from below the structure.

In the use of LED lighting, the system may be DMX controlled using conventional systems such as those available from Color Kinetics, Inc. of Boston, Mass. Such systems can be programmed for specific color changing effects and can also be used to create a "strobe" effect which causes the beads to appear as though suspended in the column.

One issue with flow through plastic tubes, such as conduits 18 and 20, is the build-up of static charge on the tubes. The static charge creates an attraction for the lightweight beads causing them to stick on the tubes. Applicant has found that spraying the tube surfaces with an anti-static spray provides short-term relief for this problem but the spray eventually wears off. Techspray, Inc. makes a permanent anti-static spray under the tradename Licron®. A better long-term solution is to protect the conduit surfaces with an anti-static film 19 (see FIG. 3) such as that sold by Policrom Screen, SpH under the tradename Polifoil Bi-As®.

As previously discussed, the simulated water or plasma flow effect can be enhanced by use of a lenticular lens 46 bonded to the inner surface of outer conduit 20 shown more clearly in FIG. 3. FIG. 3 also illustrates one form of the base unit 12 in a rectangular rather than circular shape. While the drawings are not to scale, it is noted that the columns may have varying dimensions depending upon application. For example, columns have been produced in heights from 4 feet to 24 feet with diameters from 4 inches to 16 inches.

Considering FIG. 1 in conjunction with FIG. 2, it can be seen that the base unit 12 includes air intake vents 48 for air handler 26. The air handler 26 is also preferably positioned in a separate lower section 50 of base unit 12 defined by intermediate mounting plate 52. The air circulating in conduits 18, 20 can be exhausted at least partially through screen 32 which extends across space 22. Vents (not shown) through plate 52 allow pressure relief. Air vents may also be placed in top unit 14 to allow cooling of the light system.

The action of the column in creating an illusion of flowing water (or plasma) is enhanced by use of appropriate sound effects. A sound unit 54 may be mounted in base unit 12. Unit 54 may comprise a typical sound generator of the type commercially available for producing simulated or recorded water sounds.

The present invention may also be used as an air cleaning source by incorporating an ionizing apparatus 56 into duct 28 so as to remove dust and other particulate matter from the air stream. In this form, there may be provided additional venting at top unit 14 to allow more of the cleaned air to flow out of the system.

It is also contemplated that spokes 58 may be attached to the inner surface of conduit 20 and extend into space 22. The spokes 58 are of sufficiently small diameter to be deflected by impact of the beads 24 to create a vibration to further the sounds produced by the system and enhance the illusion of falling water. Note that the conduits 18, 20 are illustrated as circular in FIG. 3 but can also be rectangular or have other configurations such as suggested by FIG. 1. While columns can be formed as extruded tubes, treatment of the columns by adding anti-static film, for example, is simplified if columns are initially formed in split designs and then bonded to form the unitary structure. The spokes 58 may be inserted from external of conduit 20 through holes drilled in the conduit and then bonded in place.

While the structure described and shown appears as a column with a defined inner and outer conduit, it will be recognized that the invention could be constructed as a series of flat, spaced plates that could be displayed as a wall hanging. For example, with three spaced plates, the beads could be blown upwards through a rear space and downward through a front space. The air handler could be in a base unit with the light source in a top unit as described for the columnar unit. By adding another plate to define a three space unit, one could create a room divider in which the illusion of water flow would be visible from opposite sides. The only difference between the plate arrangement and the illustrated columnar arrangement is the shape of the unit. Accordingly, it is intended that the invention not be limited to the disclosed embodiment but be interpreted within the scope of the appended claims.

The invention claimed is:

1. Apparatus for producing a simulated water effect comprising:

a generally transparent conduit having a first end and a second end, and including a lenticular lens circumscribing at least a portion of the conduit;

an air handler for introducing a flow of air into the first end of the conduit, the flow of air exiting the second end;

a plurality of lightweight, light reflective objects disposed in the conduit and adapted to be moved from the first end to the second end by the flow of air;

a return duct for circulating the light reflective objects from the second end to the first end; and a light source directing a beam of light of different colors onto the light reflecting objects.

2. The apparatus of claim 1 wherein the conduit is placed within the return duct.

3. The apparatus of claim 2 wherein the lenticular lens is positioned between the conduit and the return duct.

4. The apparatus of claim 3 wherein the lenticular lens is attached to an inner wall of the return duct.

5. The apparatus of claim 2 wherein the light source is positioned adjacent the second end of the conduit and directs the light beam axially through the conduit

6. The apparatus of claim 5 wherein the light source comprises a plurality of different color light emitting diodes.

7. The apparatus of claim 1 and including a second source operable in conjunction with the light source to produce sounds representative of flowing water.

8. Apparatus for creating an illusion of water or electrical plasma flow in a vertically oriented column comprising:

an inner conduit formed of a clear plastic polymer material and having a first outer diameter;

an outer conduit formed of a clear plastic polymer material and having an inner diameter greater than the outer diameter of the inner conduit, the inner conduit being axially aligned within the outer conduit and positioned to define a generally uniform space between the inner and outer conduits;

a lenticular lens adhered to an inner surface of the outer conduit;

a base unit for supporting the inner and outer conduits in their respective axially aligned positions;

an air source located in the base unit and arranged for directing a flow of air into the inner conduit;

a top unit coupled to the inner and outer conduits and defining an airflow path from the inner conduit to the space between the conduits;

a light source supported in the top unit and arranged for directing a controllable light beam downward into the inner and outer conduits; and a plurality of air movable, light reflective objects positioned in the inner conduit and adapted to be circulated up the inner conduit and down through the space between conduits by the airflow from the air source.

9. A water illusion column comprising:

a columnar unit having an inner conduit and a coaxial outer conduit each having a length greater than a largest width, the outer conduit being substantially larger in cross-section than the inner conduit so as to form an air return duct encircling the inner conduit;

an air handler coupled to the inner conduit for forcing a flow of air through the inner conduit;

air passages at each end of the inner conduit for passing air from the inner conduit to the air return duct at one end of the columnar unit and for passing air from the air return duct to the inner conduit at another end of the columnar unit;

a plurality of lightweight beads disposed in the columnar unit and being sized to pass through the air passages with the air passing therethrough;

a light source for directing light axially through the columnar unit;

an anti-static film formed on the surfaces of the inner and outer conduits that contact the beads; and wherein the inner conduit includes a lenticular lens bonded thereto.

10. The water illusion column of claim 9 wherein the light source changes colors during operation of the air handler.

11. The water illusion column of claim 9 wherein the air handler changes air flow rates to create a pulsating movement of the beads.

* * * * *